US005149988A

United States Patent [19]

Smith et al.

[11] Patent Number: 5,149,988

[45] Date of Patent: Sep. 22, 1992

[54] BICMOS POSITIVE SUPPLY VOLTAGE REFERENCE

[75] Inventors: Douglas D. Smith, Puyallup; Terrance L. Bowman, Sumner, both of Wash.

[73] Assignee: National Semiconductor Corporation, Santa Clara, Calif.

[21] Appl. No.: 610,724

[22] Filed: Nov. 7, 1990

Related U.S. Application Data

[63] Continuation of Ser. No. 287,967, Dec. 21, 1988, abandoned.

[51] Int. Cl.[5] ..... G05F 3/20

[52] U.S. Cl. ..... 307/296.6; 307/570; 307/296.7; 323/313; 323/315; 323/316

[58] Field of Search ..... 307/296.6, 296.7, 570, 307/276.8; 323/313, 315, 317

[56] References Cited

U.S. PATENT DOCUMENTS

| | | | |
|---|---|---|---|
| 3,970,876 | 7/1976 | Allen et al. | 307/296.6 |
| 4,260,946 | 4/1981 | Wheatley, Jr. | 323/314 |
| 4,267,501 | 5/1981 | Smith . | |
| 4,339,707 | 7/1982 | Gorecki | 307/296.6 |
| 4,370,608 | 1/1983 | Nagano et al. | 323/314 |
| 4,433,283 | 2/1984 | Gersbach | 307/296.6 |
| 4,675,557 | 6/1987 | Huntington | 323/314 |
| 4,675,592 | 6/1987 | Tsuzuki | 323/313 |
| 4,725,770 | 2/1988 | Okutsu et al. | 323/313 |

FOREIGN PATENT DOCUMENTS

0113865/A1 12/1983 European Pat. Off. .

OTHER PUBLICATIONS

"Regulated On-Chip Voltage Converter", IBM Technical Disclosure Bulletin, vol. 31, No. 12, May 1989.

"THAM 9.4: A 15ns 16kb ECL RAM with a PNP Load Cell", 1983 IEEE International Solid-State Circuits Conference, Digest of Technical Papers, pp. 108-109, Feb. 1983.

*Primary Examiner*—Timothy P. Callahan

*Attorney, Agent, or Firm*—Townsend and Townsend

[57] ABSTRACT

The present invention provides a voltage reference level using a bipolar output transistor to provide a reference voltage on a reference output line. A control circuit is used for varying the current to the base of the output transistor in response to the load on the reference output line. In addition, the control circuit provides the reference level to the output transistor. The MOS control circuit and the bipolar output transistor are fabricated on the same chip using a BICMOS process. The voltage reference provided by the control circuit is derived from a voltage level provided by a resistor coupled between the positive voltage supply and a current source.

12 Claims, 3 Drawing Sheets

BICMOS POSITIVE SUPPLY VOLTAGE REFERENCE

This is a continuation of Ser. No. 07/287,967, filed Dec. 21, 1988, now abandoned.

BACKGROUND

The present invention relates to BICMOS voltage reference circuits, and in particular to such reference circuits for EPROMs.

A typical prior art positive voltage reference is shown in FIG. 1. The voltage reference is provided on a line 10 from a bipolar transistor 12 which is coupled to a positive voltage supply VCC. A current source 14 provides the necessary current. Transistor 12 is biased by a resistor 16 coupled to voltage supply VCC. A second current source 18 provides the appropriate current to the base of transistor 12 to provide the appropriate voltage level at reference line 10.

FIG. 2 shows a typical use for such a reference generator circuit 20 for an ECL memory. Reference line 10 is connected through resistors 22 in row decode circuits 24 to row lines 0, 1 and 2, respectively. As can be seen, with a large number of row lines connected, the circuit of FIG. 1 will reach the maximum amount of current of current source 14 and thus pull down the voltage at reference line 10. This phenomena is shown in FIG. 3 during a switching period 26 in which a row line 1 goes high but a row line 0 has not yet discharged, causing the reference line to give a false indication of a high value on row line 2. If the current source 14 in FIG. 1 is split among enough row lines, the amount of current to each row line will decrease, thus increasing the amount of time required to discharge the row lines. Without sufficient current to quickly discharge a deselected row, the speed of the address access is slowed.

One solution is to add a discharge circuit to discharge the capacitance of a row line and thus limit the amount of current required from the voltage reference circuit. However, this adds a considerable amount of circuitry since a separate discharge circuit is required for each row line. Such a discharge circuit is shown on page 108–109 of the 1983 IEEE International Solid-State Circuits Conference Digest of Technical Papers.

SUMMARY OF THE INVENTION

The present invention provides a voltage reference level using a bipolar output transistor to provide a reference voltage on a reference output line. A control circuit is used for varying the current to the base of the output transistor in response to the load on the reference output line. In addition, the control circuit provides the reference level to the output transistor. The MOS control circuit and the bipolar output transistor are fabricated on the same chip using a BICMOS process. The voltage reference provided by the control circuit is derived from a voltage level provided by a resistor coupled between the positive voltage supply and a current source.

In a preferred embodiment, the control circuit consists of MOS transistors arranged to control the output transistor base current in response to the output current of the reference circuit and to simultaneously hold the reference line output at the reference voltage level. In one embodiment, a PMOS transistor has its source and drain coupled between the reference output and the base of the output transistor. Thus, the base current of the output transistor is coupled to the reference output to provide tracking. A second embodiment uses a current mirror configuration.

A capacitor is coupled between the voltage supply and the reference line output to counteract oscillation. A resistor is coupled to the base of the output bipolar transistor to provide biasing.

For a further understanding of the objects and advantages of the invention, reference should be made to the ensuing description taken in conjunction with the accompanying drawings.

DETAILED DESCRIPTION OF THE PREFERRED EMBODIMENTS

Figure 1:
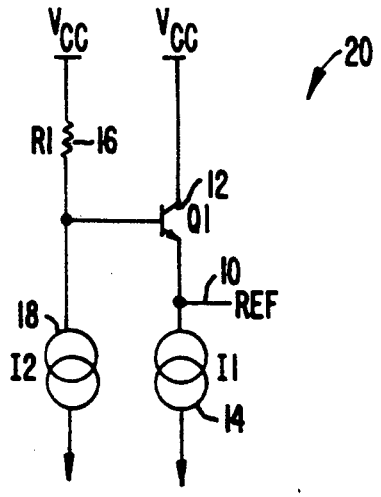
FIG. 1. PRIOR ART
FIG. 1 is a circuit diagram of a prior art voltage reference.
Figure 2:
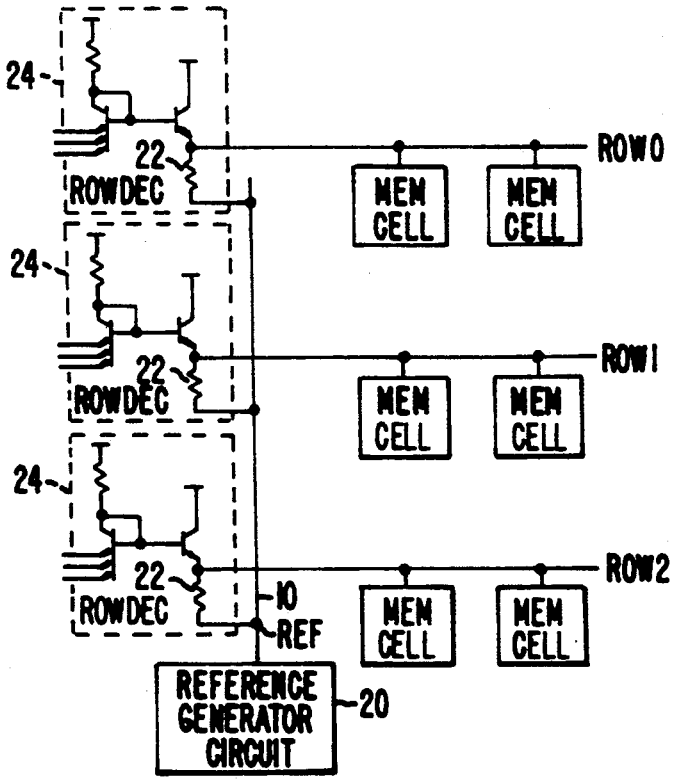
FIG. 2. PRIOR ART
FIG. 2 is a block diagram of a prior art ECL memory array using a reference generator circuit.
Figure 3:
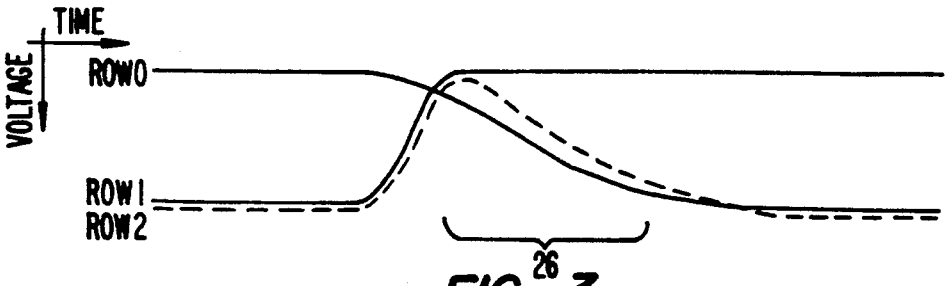
FIG. 3. PRIOR ART
FIG. 3 is a diagram showing the voltage effects of the selection of multiple rows on a voltage reference circuit according to the prior art.
Figure 4:
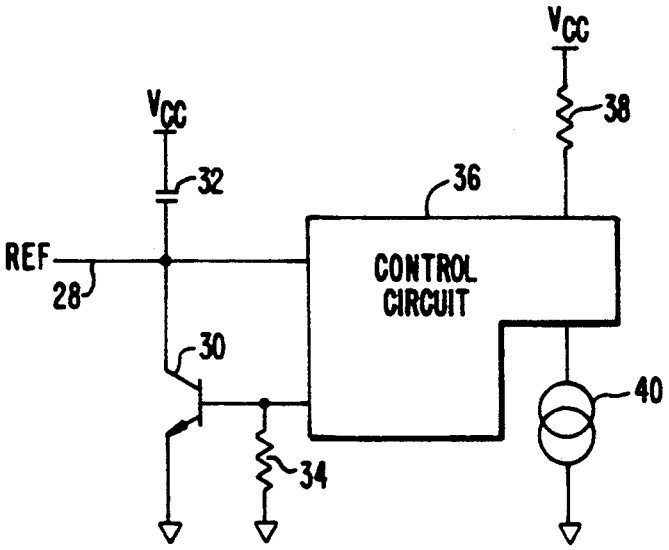
FIG. 4 is a diagram of a reference circuit according to the present invention.

FIG. 4 shows a voltage reference circuit according to the present invention. An output reference line 28 is coupled to the collector of a bipolar output transistor 30. The collector of transistor 30 is coupled through a capacitor 32 to positive voltage supply VCC. The base of transistor 30 is coupled by a resistor 34 to a ground reference level. A control circuit 36 is connected to the collector and base of transistor 30 and connects reference line 28 to a voltage reference level setting circuit which includes a resistor 38 and a current source 40.

Control circuit 36 not only supplies the voltage reference from resistor 38 and current source 40 to reference line 28, but also controls the current to the base of transistor 30 in response to the load on line 28. Resistor 34 is used to bias transistor 30 to the proper operating level. Capacitor 32 is added in order to counteract the possibility of oscillation.

Figure 5:
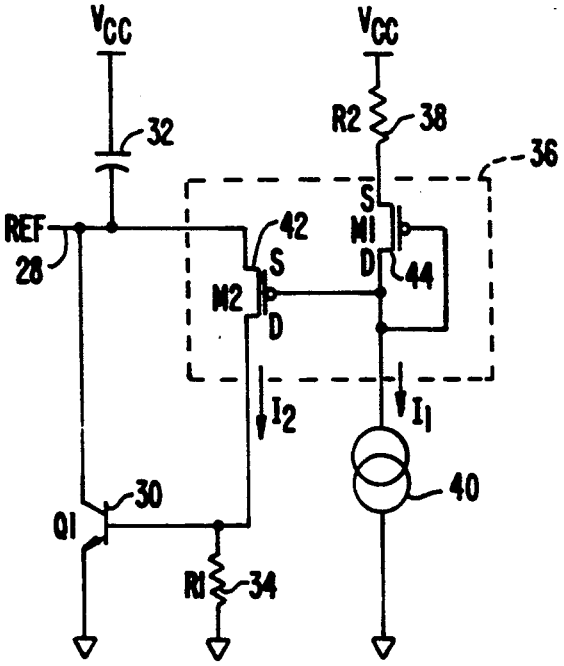
FIG. 5 is a diagram of first embodiment of the reference circuit of FIG. 4.

FIG. 5 shows a first embodiment of the control circuit 36 of FIG. 4. As can be seen, control circuit 36 includes transistors 42 and 44. Resistor 38 generates the required voltage level that is needed and is referenced to the positive supply VCC. A PMOS transistor 44 generates the proper gate voltage for PMOS transistor 42 to ensure that the source of transistor 42 will be equal to the required reference voltage. Transistor 42 also sets the DC operating current and supplies the base current to bipolar transistor 30 during transient mode high current operation. Transistors 44, and 42 form a current mirror to drive the base of transistor 30. Thus, the current $I_1$ in current source 40 is reflected as current $I_2$ into the base of transistor 30. The value of resistor 34 is chosen to provide conduction by transistor 30 at the desired level.

If the voltage on line 28 rises due to an increased load, more current is supplied through PMOS transistor 42 to the base of transistor 30 which in turn will try to pull the reference voltage on line 28 back down. If the reference voltage on line 28 decreases in voltage, less current flows through PMOS transistor 42, decreasing the base current into transistor 30, which allows the voltage reference level to rise. The DC current flowing through transistor 42 and resistor 34 biases transistor 30 at its proper operation level. The design of FIG. 5 has the advantage of a low DC operating current with a very high transient mode capability. Thus, little current is used in a steady state operation, but a large amount of current can be supplied for switching voltage levels.

Figure 6:
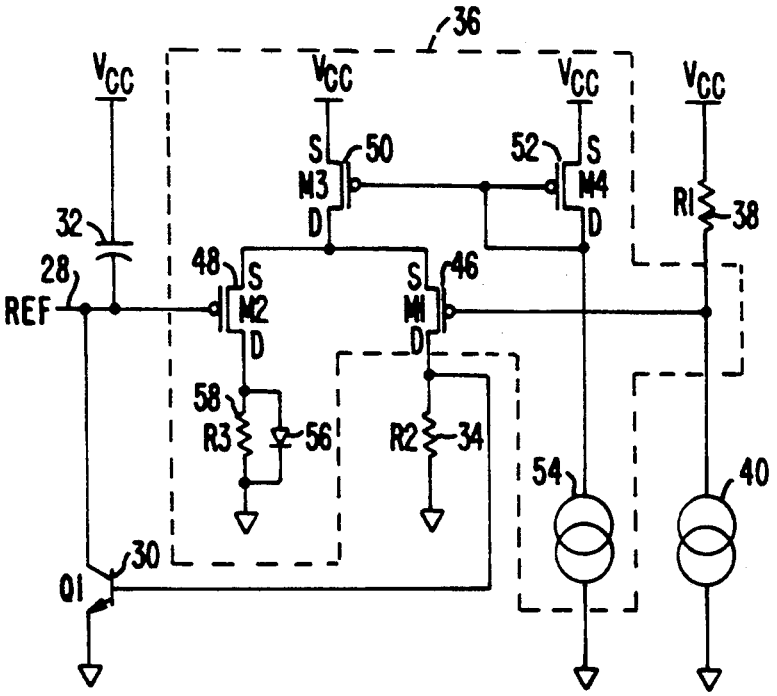
FIG. 6 is a diagram of a second embodiment of the reference circuit of FIG. 4.

FIG. 6 shows an alternate version of the circuit of FIG. 4. Again, resistor 38 generates the voltage reference, which is presented to the gate of PMOS transistor 46. Transistor 46 is coupled to another PMOS transistor 48, which has a gate which will try to equal the gate of transistor 46. Current is supplied to transistors 46 and 48 by a transistor 50, which is one leg of a current mirror consisting of transistors 50 and 52. The other leg of the current mirror includes a current source 54. Transistors 46 and 48 form a differential amplifier which drives the base of transistor 30. The differential amplifier combined with the gain of transistor 30 will force the gate of transistor 48 to the reference level. If the reference voltage on line 28 raises, less current will flow through transistor 48, and more current will flow through transistor 46 to the base of transistor 30, which will in turn try to pull the voltage reference level on line 28 down.

To equalize the load at the drain of transistors 46 and 48, a diode 56 is added between the drain of transistor 48 and the negative voltage reference to correspond to the diode drop of the base-emitter junction of transistor 30, which is in parallel with resistor 34. A resistor 58 is added in parallel with diode 56 to correspond to resistor 34. Transistors 46 and 48 are long channel length devices in order to give a constant current reference level for a varying drain to source voltage level. This is possible because a long channel length results in the gate to source voltage (Vgs) leveling off to become relatively constant as the drain current increases or the drain to source voltage varies. The embodiment of FIG. 6 has a higher DC operating current than the embodiment of FIG. 5, but the reference voltage is more accurate.

As will be evident to those of skill in the art, the present invention can be embodied in other specific forms without departing from the spirit or essential characteristics thereof. For example, a different circuit could be used to bias transistor 30, bipolar transistor 30 could be an NMOS transistor, or resistor 38 could be replaced with a diode. Accordingly, the disclosure of the preferred embodiments of the invention is to be illustrative, but not limiting, of the scope of the invention which is set forth in the following claims.

What is claimed is:

1. A reference circuit for producing a reference voltage level from a positive voltage supply, comprising:

means, coupled to said positive voltage supply, for establishing a first voltage level at a node;

an output transistor having a first output electrode coupled to a reference circuit output providing an output of said reference voltage level and having a second output electrode coupled to a second voltage supply;

control circuit means, connected to each of said node, said first output electrode and a control electrode of said output transistor, for providing said first voltage level from said node to said reference circuit output, increasing a current provided to said control electrode in response to an increase in said reference voltage level and decreasing the current to said control electrode responsive to a decrease in said reference voltage level; and a capacitor coupling said first output electrode to said positive voltage supply.

2. The reference circuit of claim 1 wherein said means for establishing a first voltage level comprises:

a first resistor coupled to said positive voltage supply; and a first current source coupled to said resistor to produce a first voltage level at said node between said first resistor and said first current source.

3. The circuit of claim 2 wherein said control circuit means comprises:

a first MOS transistor having a first output electrode coupled to said first resistor, a second output electrode coupled to said first current source at said node, and a gate coupled to said second output electrode; and a second MOS transistor having a first output electrode coupled to said output electrode, a second output electrode coupled to said control electrode of said output transistor and a gate coupled to said gate of said first MOS transistor.

4. The circuit of claim 3 wherein said MOS transistors are PMOS transistors.

5. The circuit of claim 1 wherein said control circuit means comprises a differential pair of first and second MOS transistors, said first MOS transistor having a control electrode coupled to said node, a first output electrode coupled to said control electrode of said bipolar transistor and a first load, and a second output electrode coupled to said positive voltage supply, said second MOS transistor having a control electrode coupled to said reference circuit output, a first output electrode coupled to a second load, said second load being equivalent to said first load, and a second output electrode coupled to said positive voltage supply, such that a voltage at said node will be tracked at said control electrode of said second MOS transistor.

6. The circuit of claim 5 further comprising a current mirror circuit having a first leg coupled to second output electrodes of said first and second MOS transistors and a second leg coupled to a second current source.

7. The circuit of claim 2 wherein said control circuit means comprises:

a first MOS transistor having a first output electrode coupled to said first resistor, a second output electrode coupled to said first current source, and a gate coupled to said second output electrode; and a second MOS transistor having a first output electrode coupled to said reference circuit output, a second output electrode coupled to said base of said bipolar output transistor and a gate coupled to said gate of said first MOS transistor.

8. A reference circuit for producing a reference voltage level from a first voltage supply comprising:

means, coupled to said first voltage supply, for establishing a first voltage level at a node;

an output transistor having a first output electrode coupled to a reference circuit output providing an output of said reference voltage level, a control electrode, and a second output electrode coupled to a second voltage supply;

a current mirror having a first leg for setting a first current level coupled to a second leg having an amount of current responsive to said first current level; and a differential amplifier coupled to said second leg of said current mirror having first and second differential transistors with control electrodes coupled to said node and said reference circuit output, respectively, an output electrode of said first differential transistor being coupled to said control electrode of said output transistor.

9. A reference circuit for producing a reference voltage level from a positive voltage supply, comprising:

means, coupled to said positive voltage supply, for establishing a first voltage level at a node;

a bipolar output transistor having a first output electrode coupled to a reference circuit output providing an output of said reference voltage level and having a second output electrode coupled to a second voltage supply;

control circuit means, connected to each of said node, said first output electrode and a control electrode of said output transistor, for providing said first voltage level from said node to said reference circuit output, increasing a current provided to said control electrode in response to an increase in said reference voltage level and decreasing the current to said control electrode responsive to a decrease in said reference voltage level; and a capacitor coupling said first output electrode to said positive voltage supply.

10. The circuit of claim 9 wherein said control circuit means comprises a differential pair of first and second MOS transistors, said first MOS transistor having a control electrode coupled to said node, a first output electrode coupled to said control electrode of said bipolar transistor and a first load, and a second output electrode coupled to said positive voltage supply, said second MOS transistor having a control electrode coupled to said reference circuit output, a first output electrode coupled to a second load, said second load being equivalent to said first load, and a second output electrode coupled to said positive voltage supply, such that a voltage at said node will be tracked at said control electrode of said second MOS transistor.

11. The circuit of claim 9 wherein said means for establishing a first voltage level comprises:

a first resistor coupled to said positive voltage supply; and a first current source coupled to said resistor to produce said first voltage level at said node between said first resistor and said first current source.

12. The circuit of claim 11 wherein said control circuit means comprises:

a first MOS transistor having a first output electrode coupled to said first resistor, a second output electrode coupled to said first current source, and a gate coupled to said second output electrode; and a second MOS transistor having a first output electrode coupled to said reference circuit output, a second output electrode coupled to said base of said output transistor and a gate coupled to said gate of said first MOS transistor.

* * * * *